United States Patent [19]

Watson

[11] 4,145,824

[45] Mar. 27, 1979

[54] SNOW COMPACTOR

[76] Inventor: William D. Watson, P.O. Box 250, Merrickville, Ontario, Canada

[21] Appl. No.: 885,509

[22] Filed: Mar. 13, 1978

[51] Int. Cl.[2] ..... B30B 13/00

[52] U.S. Cl. ..... 37/10; 100/233

[58] Field of Search ..... 37/10, 11; 214/300, 214/301, 302, 303, 310; 141/71; 100/214, 215, 218, 226–228, 232, 233, 45, 249

[56] References Cited

U.S. PATENT DOCUMENTS

| | | | |
|---|---|---|---|
| 3,149,428 | 9/1964 | Hukill | 37/10 |
| 3,357,346 | 12/1967 | Crafoord | 100/233 X |
| 3,455,471 | 7/1969 | Merther | 100/233 X |
| 3,759,406 | 9/1973 | Nickel | 100/233 X |
| 3,765,321 | 10/1973 | Newell | 37/10 X |
| 3,796,147 | 3/1974 | Richardson | 37/10 X |
| 3,828,663 | 8/1974 | Poplinski | 100/232 X |
| 3,908,540 | 9/1975 | Broman | 37/10 X |

*Primary Examiner*—E.H. Eickholt
*Attorney, Agent, or Firm*—W. Irwin Haskett

[57] ABSTRACT

A machine for compacting in one series of operations up to a truckload of snow removed from city streets and the like. The machine has a hopper for receiving such snow, a compacting chamber and a hydraulically operated blade for compacting snow in the chamber. The compacting chamber is positioned below and to one side of the hopper whereby it is gravity fed. The chamber has opposite, parallel, fixed sides on all but the blade and exit sides. The exit side is completely closed in by a gate. Means are provided to move the blade from a first position below and to the outer side of the hopper to a second position towards the exit gate of the chamber when in compacting action, and from this second position back to first position when in recharge action. Further means are provided to pivot the blade from a transverse, fixed, vertically oriented position when in compacting action to a transverse, fixed, horizontally oriented position when in recharge action. The blade pivots from horizontal to vertical orientation as it begins its compacting action and pivots from vertical to horizontal orientation, to enable it to knife through fresh hopper snow during its recharge action. The blade repeats its compacting and recharge actions in one series of operations until a desired amount of snow has been compacted, after which time the gate opens and the blade, acting on the compacted snow, expels it from the chamber through the gate. The machine according to the present invention enables compaction of snow into a block large enough to take up the carriage space of a dump truck in one deposit, thus minimizing the need for truck standby, and requires fewer hydraulics and consequently permits more economical construction and simpler operation than previously known snow compacters.

10 Claims, 4 Drawing Figures

SNOW COMPACTOR

BACKGROUND OF THE INVENTION

This invention relates to a machine for compacting snow, and more particularly relates to a machine for compacting up to a truckload of snow in one series of operations.

In cold climates, the buildup of snow on city streets and in parking lots and the removal of such snow is traditionally an immense problem facing inhabitants. Traditionally, snow removal in cities has involved plowing snow to the side of the roadway or parking area and removing the same by using a snow blower, front end loader or other such device to fill dump trucks which in turn carry the snow to an appropriate dumping ground. The costs of such an operation are immense. One of the main costs is in rental and operation of the dump trucks which haul the snow away. Any reduction of the time these trucks must stand by while they are waiting to be filled or while they are receiving a full load of snow, or reduction in the number of runs they must make between the snow removal area and the dump will result in cost savings for the entire operation.

Because of the compactability of snow, it has been recognized that one of the means to reduce the number of trips such trucks must make has been to provide snow compaction means at the snow removal site so that the truck is loaded with compacted snow to haul away. Snow compacting devices have been described in Breckbill, U.S. Pat. No. 3,791,053, issued Feb. 12, 1974; Newell, Canadian Pat. No. 957,559 issued Nov. 12, 1974; Broman, Canadian Pat. No. 985,951, issued Mar. 23, 1976 and Huckill, Canadian Pat. No. 714,752, issued Aug. 3, 1965.

The snow compacting devices described in these patents of Newell, Broman and Huckill all require at least two sets of compacting rams, one for compacting in a horizontal direction and the other for compacting in a vertical direction. The compacting chambers must be therefore carefully located and machined, and the hydraulic actions of the two rams carefully coordinated, to permit the machines to operate effectively.

Breckbill, on the other hand, proposes a device for feeding snow through a restricted section in an elongated hollow housing in order to compact the snow. As the snow must be constantly passed through the restriction in the housing this greatly limits the degree of compaction which can be achieved by this device.

None of the snow compacting devices described and illustrated in these references because of the massive size and complexity of the hydraulic systems which would be required, is practical or economically feasible for compacting blocks of snow of a size which would in one deposit fill a dump truck.

It is an object of the present invention to provide such a machine which will permit compacting of a block of snow up to the size of the load carrying space of a dump truck. It is a further object of the present invention to provide an economical snow compacting machine having a single, hydraulically operated blade operating in an enclosed compacting chamber.

SUMMARY OF THE INVENTION

In accordance with the present invention, a machine is provided for compacting in one series of operations up to a truckload of snow removed from city streets and the like. The machine has a hopper for receiving such snow, a compacting chamber and a hydraulically operated blade for compacting snow in the chamber. The compacting chamber is positioned below and to one side of the hopper whereby it is gravity fed. The chamber has opposite, parallel, fixed sides on all but the blade and exit sides. The exit side is completely closed in by a gate. Means are provided to move the blade from a first position below and to the outer side of the hopper to a second position towards the exit gate of the chamber when in compacting action, and from this second position back to first position when in recharge action. Further means are provided to pivot the blade from a transverse, fixed, vertically oriented position when in compacting action to a transverse, fixed, horizontally oriented position when in recharge action. The blade pivots from horizontal to vertical orientation as it begins its compacting action and pivots from vertical to horizontal orientation, so as not to disturb the compacted snow in the chamber, as it begins it recharge action. It then knifes through incoming snow from the hopper to return to first position. The blade repeats its compacting and recharge actions in one series of operations until a desired amount of snow has been compacted, after which time the gate opens and the blade, acting on the compacted snow, expels it from the chamber through the gate.

In one arrangement, the blade is guided in its motion between first and second positions by means of an axle centrally transversely secured to the rear of the blade, the ends of the axle protruding through horizontal slots on opposing sides of the compacting chamber to be guided thereby. In accordance with another aspect of the device, at least one hydraulically actuated articulated arm hydraulic or telescopic ram may be provided, one end of which is secured to the rear of the blade, the other end being secured to the machine behind the hopper, to move the blade between first and second positions and to discharge compacted snow through the gate.

BRIEF DESCRIPTION OF THE DRAWINGS

Other objects and advantages of the present invention will become apparent upon reading the following detailed description and upon reference to the drawings in which.

Similar features in the drawings have been given similar reference numerals.

While the invention will be described in connection with an example embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
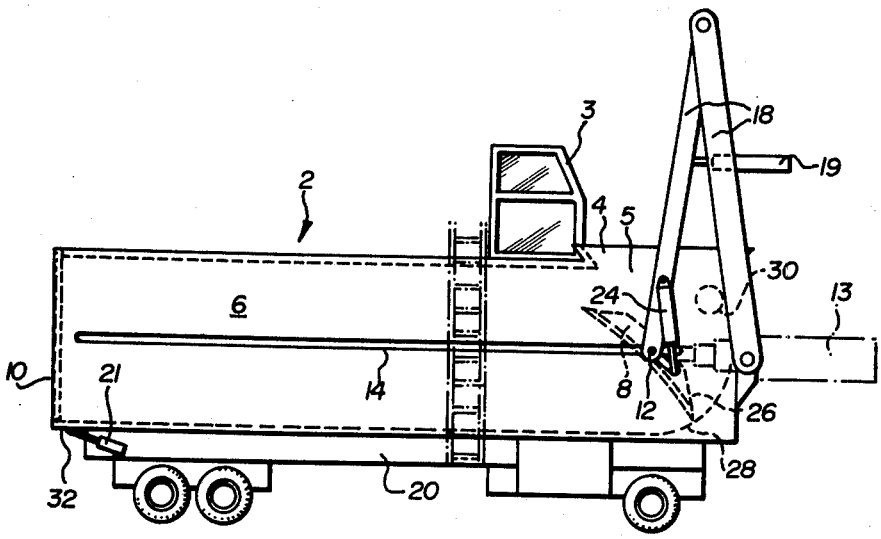
FIG. 1 is a side, section view of a snow compacting machine according to the present invention with the blade in first position, ready for compacting.
Figure 2:
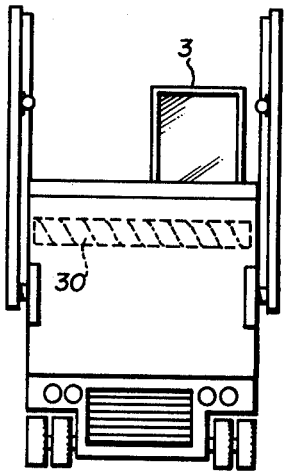
FIG. 2 is a front view of the machine of FIG. 1.

Turning to FIGS. 1 and 2, there is shown a vehicle mounted compacting machine 2 having an operator's cabin 3 towards the front of the device. A hopper entrance 4 is provided into which snow to be compacted is placed to fall to hopper 5. Compacting chamber 6, of generally rectangular shape, is positioned below and to the left of hopper 5 (FIG. 1), the chamber having opposite, parallel, fixed sides on all but blade and exit sides of the chamber. Suitable dimensions for the compaction chamber would be, for example, 15 feet long by 7½ feet wide by 5½ feet high. Hydraulically operated blade 8, of generally concave front profile to permit even distribution of snow at the point of compaction, serves as the ram by which snow is compacted in chamber 6. During the compacting operation, exit gate 10 to the rear of compacting chamber 6, remains closed. Blade 8 is provided with transverse axle 12 centrally secured to the rear of the blade, the ends of axle 12 extending through and being guided by horizontal slots 14 in the sides of compacting chamber 6. The blade is moved from side to side within the compacting chamber by means of hydraulically actuated, articulated arms 18. While the preferred embodiment having two such arms is illustrated, each arm acting on one end of axle 12, a single such articulated arm centrally disposed, is seen as an alternative construction. As a further alternative, an hydraulic or telescopic ram 13 (shown in phantom in FIG. 1) may be used in place of such arm or arms. Hydraulic cylinders 19 are appropriately positioned to act on articulated arms 18, these cylinders being fed by hydraulic reservoir 20. Also fed by this reservoir is one or more hydraulic cylinder 21 acting to open and close exit gate 10.

Figure 3:
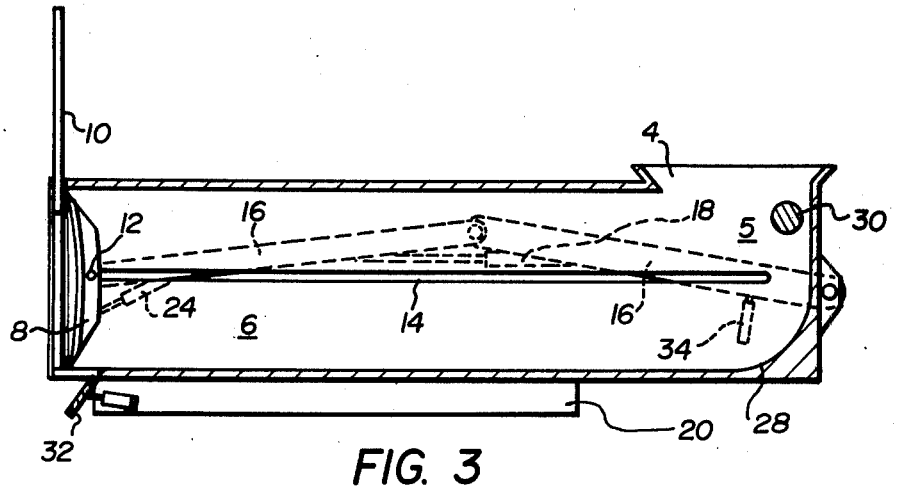
FIG. 3 is a schematic view of the compacting chamber of the machine of FIGS. 1 and 2 showing the compaction blade in fully extended position.

The blades move from a first position, illustrated in FIG. 1, when in compacting action, to a second position, as in FIG. 3. The location of the blade in second position will vary, depending upon the amount of snow being compacted, and becomes closer to the first position as increasing amounts of snow are compacted in chamber 3. Blade 8 moves from this second position back to first position when in recharge action where, back at first position, it picks up another charge of snow from hopper 5 to be compacted in chamber 6.

Figure 4:
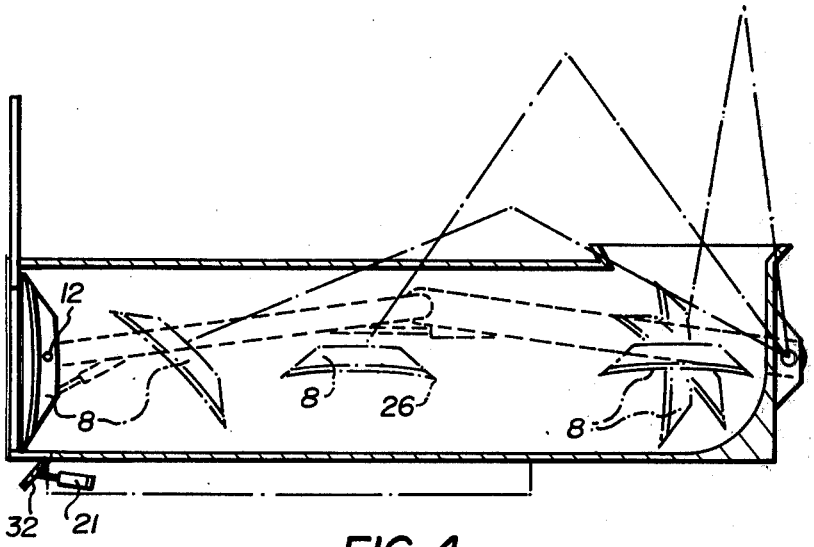
FIG. 4 is a schematic view of the compaction chamber showing the blade in recharge motion.

Blade 8 is secured to arms 16 so as to pivot about axle 12 in a vertical plane, from the vertical position shown in FIG. 3 to the horizontal position seen in FIG. 4, under the action of hydraulic cylinder 24. Hydraulic cylinder 24 is similarly fed by reservoir 20. The blade is pivoted from its vertical compacting position of FIGS. 1 and 3, to the horizontal position seen in FIG. 4 when the blade begins its recharge action, and pivots from that horizontal position back to its vertical orientation (phantom, FIG. 4) when it begins its compacting action. The bottom of the blade is sharpened to a "V" shape 26 to enable the blade to knife through snow of the hopper as it returns to first position (FIG. 4). To prevent buildup and compaction of hopper snow to the rear of the blade, curved wall 28 is provided at the lower, rear section of the machine below hopper 5.

As an optional feature, to prevent compacting of snow at hopper entrance 4 or in hopper 5, an agitator disc or worm gear 30, for example, energized from the existing hydraulic system, may be provided.

A rear hydraulically operated tailgate 32 is provided beneath the machine's exit gate 10 to withdraw the bottom rear part of the machine in the area of the exit gate and permit trucks to back in more closely to receive compacted snow. Additionally, appropriate hydraulic lifts 34, illustrated schematically in FIG. 3, may be provided on the vehicle beneath the machine to raise or lower the machine with respect to the vehicle body to account for variations in dump truck heights and assist in discharging the compacted snow directly from the machine onto the dump truck or indeed, to enable the machine to directly stock compacted blocks, e.g., to one side of a parking lot.

In operation, snow to be compacted is placed in hopper 5 for example by a snow blower, front end loader or the like. Blade 8, moving from first position to second, picks up some of the snow from the hopper and compacts it in chamber 6, against closed exit gate 10 and the sides of chamber 6. Blade 8 pivots from its vertically oriented position, so as not to disturb compacted snow in the chamber, as it begins its recharge action (FIG. 4) and knifes back to its first position in the area below hopper 5 where it again pivots to vertical position and picks up more snow to be compacted with the snow which was originally compacted. This series of operations is repeated until a desired volume of compacted snow has been formed in the compacting chamber. The machine is of a size and strength to enable compacting of up to a truckload of snow in one series of such operations.

When sufficient snow has been compacted, exit gate 10 is opened and hydraulic tailgate floor section 32 is lowered (FIG. 3) to enable a dump truck to back up to the rear of the vehicle. Blade 8 then forces the compacted block of snow through the rear of the compaction chamber 6 onto the truck. Hydraulic tailgate floor section 32 is positioned, with respect to the rearward limit of blade 8 permitted by grooves 14, such that when it is lowered, the block of compacted snow will clear the floor of the machine when the blade is in this extreme position.

Once the compacted snow has been loaded onto a truck, exit gate 10 and tailgate 32 are closed and the compacting operation may be repeated. It will be noted that snow compacted in this way is in a more cohesive form for cartage.

Thus it is apparent that there has been provided, in accordance with the invention, a machine for compacting snow which fully satisfies the objects, aims and advantages set forth above. While the invention has been described in conjunction with an example embodiment thereof, it is evident that many alternatives, modifications and variations will be apparent to those skilled in the art in light of the foregoing description. For example, while the invention is described as being a snow compacting machine, it is envisaged that the machine of this invention will effectively compact other things such as leaves or even garbage, prior to placing such in a truck for removal to a dump. Accordingly, it is intended to embrace all such alternatives, modifications and variations as fall within the spirit and broad scope of the appended claims.

I claim as my invention:

1. A machine for compacting snow or other compactible material, having a hopper for receiving such snow, a compacting chamber and a hydraulically operated blade for compacting snow in the chamber, the improvement wherein the machine is designed to compact up to a truckload of snow in one series of operations, the compacting chamber being positioned below and to one side of the hopper whereby it is gravity fed, the chamber having opposite, parallel, fixed sides including a floor on all but blade and exit sides; the exit side being completely closed in by a gate; means being provided to move the blade from a first position below and to the outer side of the hopper to a second position towards the exit gate of the chamber when in compacting action and from second position back to first position when in recharge action; means being provided to pivot the blade from a transverse, fixed, vertically oriented position when in compacting action to a transverse, fixed, horizontally oriented position when in recharge action; further means being provided to pivot the blade from horizontal to vertical orientation as it begins its compacting action and to pivot it from vertical to horizontal orientation, so as not to disturb compacted snow in the chamber, as it begins its recharge action; the blade to repeat its compacting and recharge action in one series of operations until a desired amount of snow has been compacted, after which time the gate opens and the blade, acting on the compacted snow, expels it from the chamber through the gate.

2. A machine according to claim 1, wherein the dimensions and shape of the compacting chamber and those of the blade are such as to permit compacting of snow to a volume and shape which will fit the back of a standard dump box of a trunk.

3. A machine according to claim 1, wherein the front of the blade has a concave profile.

4. A machine according to claim 3, wherein the bottom of the blade when in vertical position becomes the forward edge of the blade when moving from second back to first position, and wherein this part of the blade is "V"-shaped to give the blade a knifing action as it cuts through snow from the hopper to return to first position.

5. A machine according to claim 1, wherein agitation means are provided in the hopper above the blade when in first position to prevent compaction of snow in the hopper.

6. A machine according to claim 1, wherein the blade is guided between first and second positions by means of an axle centrally transversely secured to the rear of the blade, the ends of the axle extending through horizontal slots on opposite sides of the compacting chamber and horizontally guided thereby.

7. A machine according to claim 6, wherein hydraulic means act on the axle to move the blade horizontally and to pivot the blade between vertical and horizontal positions.

8. A machine according to claim 7, wherein the blade is moved horizontally by at least one hydraulically actuated, articulated arm, one end of which is secured to an axle centrally transversely secured to the rear of the blade, the other end being secured to the rear of the machine behind the hopper.

9. A machine according to claim 8, having two hydraulically actuated articulated arms to move the blade, each acting on one end of the axle extending through the slots.

10. A machine according to claim 1, further provided with an hydraulically operated tailgate floor section positioned with respect to the rearward limit of the blade permitted such that when it is lowered, a block of compacted snow being expelled from the machine will clear the floor of the machine.

* * * * *